United States Patent [19]

Boskamp

[11] Patent Number: 4,539,133

[45] Date of Patent: Sep. 3, 1985

[54] PROCESS FOR PREPARATION OF AN ANTI-CORROSIVE AQUEOUS LIQUID DETERGENT COMPOSITION

[75] Inventor: Jelles V. Boskamp, Vlaardingen, Netherlands

[73] Assignee: Lever Brothers Company, New York, N.Y.

[21] Appl. No.: 584,670

[22] Filed: Feb. 29, 1984

[30] Foreign Application Priority Data

Mar. 2, 1983 [GB] United Kingdom ..... 8305790

[51] Int. Cl.[3] ..... C11D 9/10

[52] U.S. Cl. ..... 252/109; 252/135; 252/DIG. 14

[58] Field of Search ..... 252/109, 135, DIG. 14

[56] References Cited

U.S. PATENT DOCUMENTS

| | | | |
|---|---|---|---|
| 3,085,982 | 4/1963 | Steer et al. | 252/137 |
| 3,257,325 | 6/1966 | Koster et al. | 252/135 |
| 3,285,859 | 11/1966 | Jelen | 252/109 |
| 3,325,413 | 6/1967 | Novak, Jr. | 252/135 |
| 3,782,906 | 1/1974 | Pierce | 252/135 |
| 3,847,663 | 11/1974 | Shumaker | 252/135 |
| 3,879,527 | 4/1975 | Bertorelli et al. | 252/135 |
| 3,931,036 | 1/1976 | Pierce | 252/135 |
| 4,157,978 | 6/1979 | Llenado | 252/109 |

*Primary Examiner*—Paul Lieberman
*Assistant Examiner*—Willie Thompson
*Attorney, Agent, or Firm*—Milton L. Honig; James J. Farrell

[57] ABSTRACT

The invention pertains to a process for preparing a neutral or low alkaline silica containing aqueous liquid detergent composition comprising the step of introducing particulate alkalimetal silicate into the aqueous base at a temperature of below 50° C. Compositions accordingly prepared show excellent anti-corrosive behavior towards metal and enamel surfaces.

7 Claims, No Drawings

PROCESS FOR PREPARATION OF AN ANTI-CORROSIVE AQUEOUS LIQUID DETERGENT COMPOSITION

This invention relates to a process for preparing liquid detergent compositions and in particular to a process for preparing such compositions using silicates as corrosion-inhibiting agents.

It is desirable to include an anti-corrosion agent in detergent compositions in order to inhibit the corrosive and discolouring influences of the washing liquid on metal or enamel parts of washing machines and to prevent thereby the malfunctioning of such machines and the discolouring of fabrics which come into contact with such corroded parts.

In the art of manufacturing detergents alkalimetal silicates, such as di- and tri-silicates or the more water-soluble meta-, ortho- and sesqui-silicates, are widely used in order to achieve corrosion inhibition, buffering and building properties. Although in the liquid detergent area the inclusion of silicates is not uncommon, the formulator is generally confronted with considerable problems relating to the theology and stability of the detergent system due to the addition of effective amounts of silicate. Especially in liquids of the suspending type such inclusion often gives rise to an unacceptable increment in viscosity.

It has now been found that effective amounts of an alkalimetal silicate, such as di- or tri-silicate, can be incorporated in liquid detergent compositions without affecting the viscosity unacceptably, if the silicate is added at a temperature of below 50° C. in particulate form, the final aqueous composition having a neutral or low-alkaline pH. Under such process conditions the particulate silicate appears not to dissolve as silicate ions, but is believed to be transformed into silica. Surprisingly detergent compositions are obtained showing anti-corrosive properties equivalent to conventionally prepared silicate-containing products, i.e. products in which the silicate is incorporated as a waterglass solution, without any negative effect on the viscosity behaviour.

Accordingly, the present invention provides a process for the preparation of a neutral or low-alkaline silica-containing aqueous liquid detergent composition, characterized by the step of admixing particulate alkalimetal silicate into the aqueous base at a temperature of below 50° C.

The particulate alkalimetal silicate may either be added to partly replace the electrolyte which is needed to provide the suspending structure to the liquid detergent composition, or it may be added completely in addition to the structuring electrolyte. In the latter case the process of the invention additionally comprises the step of neutralization to neutral or low-alkaline pH.

In order to achieve effective anti-corrosion protection the level of silica in the wash liquor must be equal or above about 2 mmol/liter. Accordingly, the particulate silicate is normally incorporated in the composition in an amount of from about 1% to 10% by weight, preferably 2% to 5% and most preferably 2% to 4% by weight of the total liquid detergent composition, the ranges being defined for an in-wash liquid detergent dosage of about 10 g/liter.

If a liquid detergent composition is formulated having a preferred dosage which is different from 10 gram/liter, the amount of silicate that should be incorporated to achieve adequate anti-corrosion protection must be adjusted accordingly, so that the amount of silicate corresponds with the ranges as defined for 10 g/l product dosage.

The silicate to be used in the process of the present invention has the formula $(Me_2O)_x.(SiO_2)_y$, Me being Na, K or Li and the ratio x:y ranging from about 1:0.9 to 1:3.5, preferably 1:1.5 to 1:2.5.

The particle size of the particulate silicate is not a very critical factor and in general may range from 1 to 1000 $\mu$, preferably from 10 to 100 $\mu$.

Suitable silicates may be readily obtained commercially. They are sold, for example, under the Registered Trade Names Soluble C, Silicate A1, A2 (ex Crosfield, UK) and Portil A and AW (ex Henkel, Germany).

It is essential in the process of the present invention that the silicate is added to the composition at a temperature of below 50° C. Preferably the silicate is added below 40° C., and most preferably at ambient temperature, such as at a temperature within the range of from 15° to 25° C.

The liquid detergent compositions of the invention further comprise as essential ingredient an active detergent material, which may be an alkali metal or alkanolamine soap of $C_{10}$–$C_{24}$ fatty acid, including polymerized fatty acids, or an anionic, nonionic, cationic, zwitterionic or amphoteric synthetic detergent material, or a mixture of any of these. The anionic synthetic detergents are synthetic detergents of the sulphate- and sulphonate-types. Examples thereof are salts (including sodium, potassium, ammonium and substituted ammonium salts, such as mono-, di- and tri-ethanolamine salts) of $C_9$–$C_{20}$ alkyl benzene sulphonates, $C_8$–$C_{22}$ primary or secondary alkane sulphonates, $C_8$–$C_{24}$ olefin sulphonates, sulphonated polycarboxylic acids, prepared by sulphonation of the pyrolized product of alkaline earth metal citrates, e.g. as described British Patent Specification No. 1 082 179, $C_8$–$C_{22}$ alkyl sulphates, $C_8$–$C_{24}$ alkyl polyglycol ethersulphates (containing up to 10 moles of ethylene oxides); further examples are described in "Surface Active Agents and Detergents" (Vol. I and II) by Schwartz, Perry and Berch.

Examples of nonionic synthetic detergents are the condensation products of ethylene oxide, propylene oxide and/or butylene oxide with $C_8$–$C_{18}$ alkylphenols, $C_8$–$C_{18}$ primary or secondary aliphatic alcohols, $C_8$–$C_{18}$-fatty acid amides; further examples of nonionics include tertiary amine oxides with one $C_8$–$C_{18}$ alkyl chain and two $C_1$–$C_3$ alkyl chains. The above reference also describes further examples of nonionics.

The average number of moles of ethylene oxide and/or propylene oxide present in the above nonionics varies from 1 to 30; mixtures of various nonionics, including mixtures of nonionics with a higher degree of alkoxylation, may also be used.

Examples of cationic detergents are the quaternary ammonium compounds such as alkyl dimethyl ammonium halogenides.

Examples of amphoteric or zwitterionic detergents are N-alkylamino acids, sulphobetaines and condensation products of fatty acids with protein hydrolysates, but owing to their relatively high cost they are usually used in combination with an anionic or a nonionic detergent. Mixtures of the various types of active detergents may also be used, and preference is given to mixtures of an anionic and a nonionic detergent-active compound. Soaps (in the form of their sodium, potassium, and substituted ammonium salts, such as of polymerized fatty acids, may also be used, preferably in conjunction with an anionic and/or a nonionic synthetic detergent.

The amount of the active detergent material varies from 1 to 60%, preferably from 2 to 40% and particularly preferably from 5 to 25% by weight. When a soap is incorporated, the amount thereof is from 1 to 40% by weight.

The liquid compositions of the invention further contain up to 60% of a suitable builder, such as sodium, potassium and ammonium or substituted ammonium pyro- and tripolyphosphates, -ethylenediamine tetraacetates, -nitrilotriacetates, -ether polycarboxylates, -citrates, -carbonates, -orthophosphates, zeolites, carboxymethyloxysuccinates, etc. Particularly preferred are the polyphosphate builder salts, nitrilotriacetates, citrates, zeolites, and mixtures thereof. In general the builders are present in an amount of from 1 to 60%, preferably from 5 to 40% by weight of the final composition.

The amount of water present in the detergent compositions of the invention varies from 10 to 70% by weight.

Other conventional materials may be present in the liquid detergent compositions of the invention, for example sequestering agents, such as ethylenediaminetetraphosphonic acid; soil-suspending agents, such as sodium carboxymethylcellulose, polyvinylpyrrolidone or the maleic anhydride/vinylmethylether copolymer; hydrotropes; dyes; perfumes; optical brighteners; germicides; anti-tarnishing agents; suds boosters; suds depressants, such as liquid polysiloxane anti-foam compounds; enzymes, particularly proteolytic enzymes, such as the commercially available subtilisins Maxatase® (ex Gist-Brocades N.V., Delft, The Netherlands), Alcalase®, Esperase® Savinase® (ex Novo Industri A/S, Copenhagen, Denmark), amylolytic and cellulolytic enzymes; enzyme stabilizing systems, such as a mixture of a polyol with boric acid or an alkali-metal borate; oxygen liberating bleaches, such as sodium perborate or percarbonate, diperisophthalic anhydride with or without bleach precursors, such as tetraacetyl ethylene diamine; or chlorine liberating bleaches, such as dichlorocyanurate; anti-oxidants, such as sodium sulphites; opacifiers; fabric softening agents; stabilizers, such as polysaccharide hydrocolloids, e.g. partially acetylated xanthan gum, commercially available as "Kelzan" (ex Kelco Comp., N.J., USA); buffers and the like.

Compositions prepared by the process of the present invention should have neutral or low-alkaline pH values. Generally the pH value is below 9.5, but preferred are values in the range of from 7.0 to 8.5.

In particular the present process is suitable for the preparation of aqueous liquid silica-containing detergent compositions comprising from 5 to 25% by weight of a soap and/or synthetic detergent and from 5 to 40% of a detergency builder having a pH of below 9.5.

Viscosities are considerably lower than those of equivalent compositions in which the silicate is incorporated as an alkaline solution, and normally range from about 0.3 to 1.5 Pa.s or even 0.5 to 1.0 Pa.s at 21 $sec^{-1}$ and 20° C.

The invention will be further illustrated in the following Examples. All percentages herein are by weight unless otherwise specified.

EXAMPLES 1-8

In order to illustrate the advantages of the process of the invention especially with respect to the viscosity behaviour of the compositions accordingly prepared, incorporation of silicate in dissolved form (waterglass solution) was compared to incorporation of silicate in particulate form.

As a basic composition the following fabric washing liquid detergent was prepared:

| Ingredient | % |
|---|---|
| Dodecyl benzene sulphonic acid | 7 |
| Oleic acid | 1 |
| Alcohol ethoxylate ($C_{13}$-$C_{15}$, $EO_7$) | 2 |
| Coconut diethanolamide | 1 |
| Sodium hydroxide | 1.5 |
| Enzyme | 1 |
| Glycerol | 5 |
| Sodium pentaborate | 2 |
| Sodium triphosphate | 25 |
| Minor ingredients + water | balance |
| pH | 7.7 ± 0.2 |
| Viscosity (20° C., 21 $sec^{-1}$) | 0.7-0.9 Pa s |

Two methods were used to incorporate the silicate in the above composition. In a first embodiment of the invention the silicate was used as a partial replacement of the alkalimetal hydroxide and thus contributed to the establishment of the suspending structure of the liquid composition. In this process the silicate was added to the composition at pH=6.2. After the suspending structure was formed, the pH of the final composition was 7.7. In a second embodiment of the invention the silicate was not used to replace part of the hydroxide and therefore did not contribute to the formation of the suspending structure of the liquid. In this process the silicate was added to the liquid composition at pH=7.7, after the suspensing structure had formed. Due to the addition of the silicate the pH value increased to about 9.4, after which the composition was neutralized to about pH=7.7.

In both methods the silicate was added at ambient temperature.

In Table 1 the results are presented for the various silicates incorporated in the fabric washing composition by way of the two methods described above.

In the last column of Table 1 results are presented obtained by a corrosion inhibiting efficiency test. The test experiments were carried out on an aluminium pumping house of a fabric washing machine. The lid of the pumping house was immersed in a 1% product solution, the surface area of aluminium compared to the volume of the test solution being about 20 $cm^3$ solution per $cm^2$ of Al. The Al-loss due to corrosion was measured during a number of cycles, each cycle consisting of the following steps:

(1) immersion in fresh test solution of ambient temperature;
(2) heating to 60° C. in about 50 minutes;
(3) keeping the temperature at 60° C. for 10 minutes;
(4) rinsing the aluminium lid.

The results are expressed (in %) relative to the Al-weight loss of the control solution (i.e. the detergent solution without silicate added).

EXAMPLES 9–10

In these examples the effect obtained by the process of the invention is illustrated for compositions having a lowered electrolyte content.

Basically the same composition was used as in Examples 1–8, except for the amount of sodium triphosphate, which was lowered to 10%.

| Example No. | Type and amount of silicate | Form | Viscosity (Pa s) Method 2 |
|---|---|---|---|
| 9 | 3% of disilicate Soluble C | particulate | 0.56 |
| 10 | 9% of alkaline waterglass | solution | 1.15 |

The advantageous effect on the viscosity is clearly demonstrated.

EXAMPLE 11

In a comparative experiment the following basic composition was prepared:

| Ingredient | % |
|---|---|
| Sodium dodecyl benzene sulphonate | 5.5 |
| Alcohol ethoxylate ($C_{13}$–$C_{15}$, $EO_7$) | 2 |
| Glycerol | 10 |
| Borax | 7 |
| Sodium triphosphate | 21 |
| Sodium disilicate | 3 |
| Carbopol 941 (polyacrylate ex Goodrich, USA) | 0.4 |
| Minor ingredients + water | balance |

Addition at ambient temperature of the sodium disilicate in powdered form resulted in a viscosity of 0.77 Pa s, whereas addition as a waterglass solution resulted in a viscosity of 2.50 Pa s.

| Ingredient | % |
|---|---|
| Sodium dodecyl benzene sulphonate | 5.5 |
| Alcohol ethoxylate ($C_{13}$–$C_{15}$, $EO_7$) | 2 |
| Glycerol | 10 |
| Borax | 7 |
| Sodium triphosphate | 21 |
| Sodium disilicate | 3 |
| Carbopol 941 (polyacrylate ex Goodrich, USA) | 0.4 |
| Minor ingredients + water | balance |

Addition at ambient temperature of the sodium disilicate in powdered form resulted in a viscosity of 0.77 Pa s, whereas addition as a waterglass solution resulted in a viscosity of 2.50 Pa s.

TABLE I

| Example | Type and amount of silicate* | Form | Viscosity (Pa s) Method 1 | Viscosity (Pa s) Method 2 | Relative weight loss of Al in % |
|---|---|---|---|---|---|
| 1 | No silicate added | — | 0.92 | | 100.0 |
| 2 | 3% Disilicate A1 | particulate | 1.16 | 0.84 | 10.7 |
| 3 | 3% Disilicate A2 | particulate | 1.02 | 0.71 | 24.0 |
| 4 | 2% Trisilicate LA | particulate | 1.19 | 0.75 | 4.4 |
| 5 | 3% Disilicate Soluble C | particulate | 1.29 | 0.71 | 6.7 |
| 6 | 9% Alkaline waterglass | solution | 4.70 | — | 11.0 |
| 7 | 7.5% Neutral waterglass | solution | 1.75 | — | 5.1 |
| 8 | 6% Alkaline waterglass | solution | — | 1.06 | 18.4 |

| | | Sieve residue on 0.06 mm | 0.10 mm | 0.15 mm | 0.25 mm |
|---|---|---|---|---|---|
| *Disilicate A1: | $Na_2O.2.1\ SiO_2$ | 98% | 85–93% | 60–80% | 10–40% |
| Disilicate A2: | $Na_2O.2.1\ SiO_2$ | 80–92% | 37–60% | 7–20% | 1% |
| Trisilicate LA: | $Na_2O.3.3\ SiO_2$ | 90–95% | 75–85% | 25–35% | 5% |
| Disilicate Soluble C: | $Na_2O.2.1\ SiO_2$ | 90–98% | 60–80% | 40–60% | 20–40% |
| Alkaline waterglass: | 33% solution of $Na_2O.2\ SiO_2$ | | | | |
| Neutral waterglass: | 40% solution of $Na_2O.3.3\ SiO_2$ | | | | |

Table 1 clearly demonstrates the considerable reduction in viscosity if the silicate is incorporated in particulate form, compared to conventional incorporation by way of waterglass solution.

I claim:

1. Process for the preparation of a neutral or low-alkaline silica-containing aqueous liquid detergent composition, comprising the step of admixing particulate alkalimetal silicate into the aqueous detergent base at a temperature of below 50° C., said detergent base comprising from 5 to 25% by weight of a soap and/or synthetic detergent and from 5 to 40% by weight of a detergency builder.

2. Process according to claim 1, comprising the further step of neutralization to neutral or low-alkaline pH.

3. Process according to claim 1 or 2, wherein the alkalimetal silicate is admixed in an amount of from 1 to 10% by weight of the total composition.

4. Process according to any one of claim 3, wherein the alkalimetal silicate is admixed in an amount of from 2 to 4% by weight of the total composition.

5. Process according to claim 1 or 2, wherein the alkalimetal silicate has the formula $(Me_2O)_x.(SiO_2)_y$, Me being Na, K or Li and the ratio x:y ranging from about 1:0.9 to 1:3.5.

6. Process according to claim 1 or 2, wherein the alkalimetal silicate has the formula $(Me_2O)_x.(SiO_2)_y$, Me being Na, and the ratio K or Li x:y ranging from about 1:1.5 to 1:2.5.

7. Process according to claim 1 or 2, wherein the alkalimetal silicate is admixed at a temperature of between 15° and 25° C.

* * * * *